United States Patent [19]

Tax et al.

[11] 4,040,667

[45] Aug. 9, 1977

[54] APPARATUS FOR RECOVERING PARTICULATE MATERIAL FROM THE SEA BOTTOM

[75] Inventors: Hans Tax, Munich; Herbert Kurz, Putzbrunn, both of Germany

[73] Assignee: Hans Tax, Munich, Germany

[21] Appl. No.: 604,151

[22] Filed: Aug. 13, 1975

[30] Foreign Application Priority Data

Aug. 16, 1974 Germany ..... 2439485

[51] Int. Cl.[2] ..... E02F 5/00; E02F 9/06

[52] U.S. Cl. ..... 299/8; 37/57; 37/70; 37/72; 254/173 R

[58] Field of Search ..... 299/8, 9; 37/54, 57, 37/56, 71, 72, DIG. 8, 55; 114/16.8, 235 B; 166/.5, .6; 43/8; 254/173 R; 214/13

[56] References Cited

U.S. PATENT DOCUMENTS

| | | | |
|---|---|---|---|
| 2,661,550 | 12/1953 | Graham | 37/54 UX |
| 3,159,806 | 12/1964 | Piasecki | 114/235 B |
| 3,469,821 | 9/1969 | Gross et al. | 114/235 B |
| 3,522,670 | 8/1970 | Flipse et al. | 299/8 X |
| 3,556,598 | 1/1971 | Smith | 37/57 |
| 3,596,070 | 7/1971 | McCool | 114/235 B |
| 3,638,338 | 2/1972 | Nelson | 37/72 X |
| 3,656,095 | 4/1972 | Cavey | 114/235 B |
| 3,697,134 | 10/1972 | Murray | 299/8 |
| 3,829,160 | 8/1974 | Condolios | 37/DIG. 8 |
| 3,905,137 | 9/1975 | Gee | 37/56 |

FOREIGN PATENT DOCUMENTS

| | | | |
|---|---|---|---|
| 1,484,764 | 3/1969 | Germany | 37/54 |
| 1,075,260 | 7/1967 | United Kingdom | 37/DIG. 8 |

*Primary Examiner*—Ernest R. Purser
*Assistant Examiner*—William F. Pate, III
*Attorney, Agent, or Firm*—Hans Berman

[57] ABSTRACT

A hydraulic dredge for recovering manganese nodules from the sea bottom includes a transfer station suspended from a mother ship at a fixed depth from the surface and a dredging tool assembly suspended from winches on the transfer station by means of cables whose effective lengths are varied in response to depth signals from sensors respectively associated with the cables on respective parts of the tool assembly to keep the same contiguously adjacent the sea floor surface in parallel relationship.

17 Claims, 6 Drawing Figures

APPARATUS FOR RECOVERING PARTICULATE MATERIAL FROM THE SEA BOTTOM

This invention relates to the recovery of particulate material from the bottom of the sea, and particularly to apparatus for recovering coarse particles which are valuable sources of metals and are commonly referred to as "manganese nodules" even if manganese is only a minor constituent.

It was proposed heretofore (see "Stahl und Eisen", 1971, No. 8, page 157) to suspend a floating transfer station below a mother ship traveling over the surface, and to withdraw nodules from the sea bottom by means of a suction hose mounted on the transfer station from which they are further conveyed to the surface ship.

It has been found that the success of this recovery arrangement is determined largely by the manner in which the tool scooping the nodules from the sea bottom is controlled. Tool assemblies which travel on the sea bottom by means of wheels or runners proved unsatisfactory because the sea bottom is frequently very soft in the neighborhood of manganese nodules so that the tool sinks below the nodule carrying surface and picks up more worthless sludge than nodules. The specific nature of the tool is relatively irrelevant to this problem, and it affects that afore-mentioned suction hose in the same manner as other dredging tools.

It is a primary object of the invention to provide apparatus for recovery of manganese nodules from the bottom of the sea which prevents the dredging tool assembly from sinking into sludge, but still keeps the tool contiguously adjacent the bottom surface where the nodules are located.

With this object and others in view, as will presently become apparent, the recovery apparatus of the invention provides a transfer station with means for suspending the station from a surface ship at a fixed depth. A flexible tension member, such as a cable, rope, or chain, depends from a winch mounted on the station. A dredging tool assembly is suspended by the tension member from the transfer station. A sensing device on the assembly senses the spacing of the assembly from the bottom of the sea and is connected to a control for the winch so that the winch is operated in response to the sensed spacing for varying the effective length of the tension member between the winch and the tool assembly. As is known in itself, a first conveyor conveys dredged material from the tool assembly to the transfer station, and a second conveyor forwards the material from the station to the surface ship.

Other features, additional objects, and many of the attendant advantages of this invention will readily be appreciated as the same becomes better understood from the following detailed description of preferred embodiments when considered in connection with the appended drawing in which.

Figure 1:
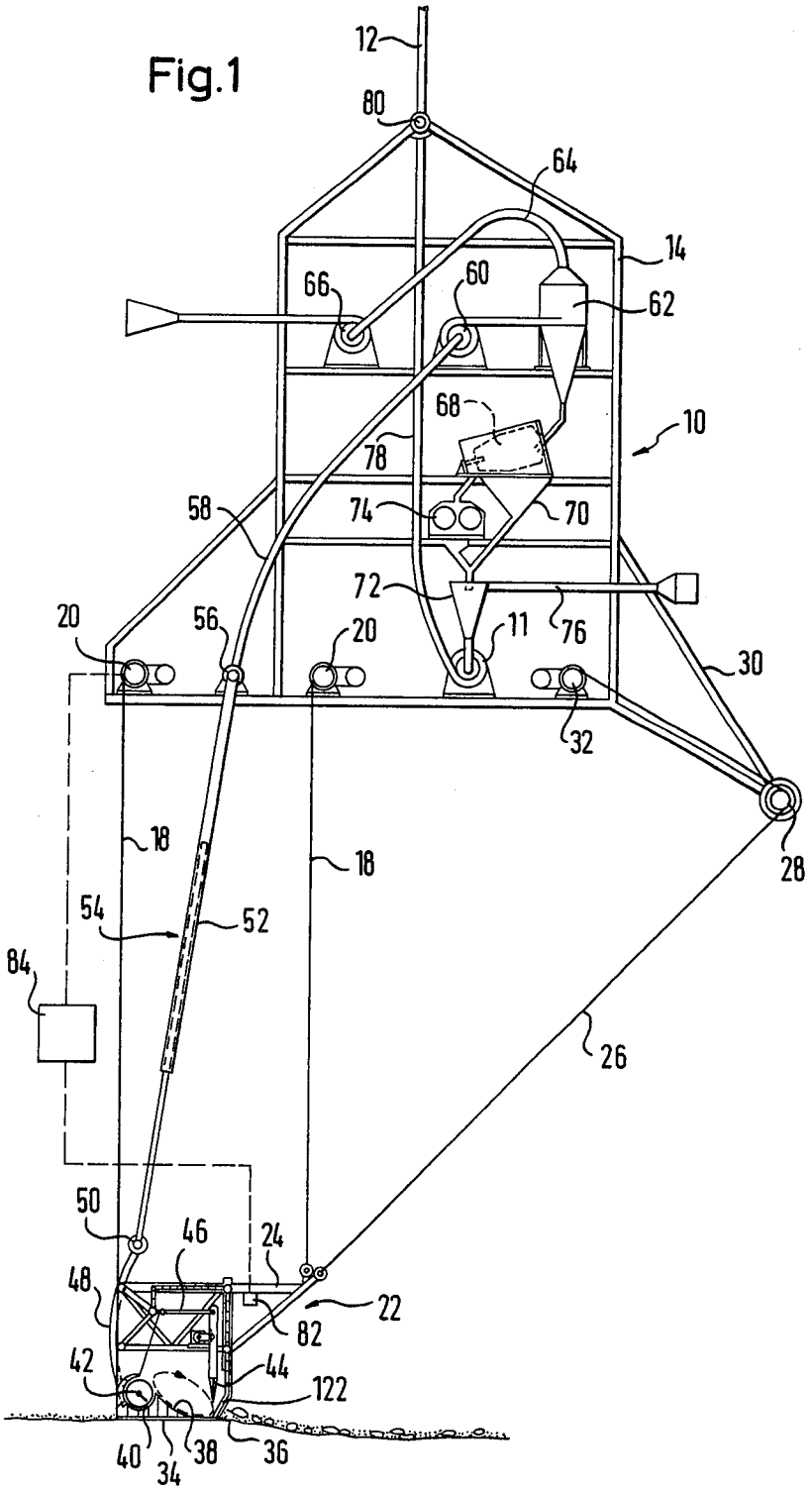
FIG. 1 shows apparatus according to the invention in side elevation.
Figure 2:
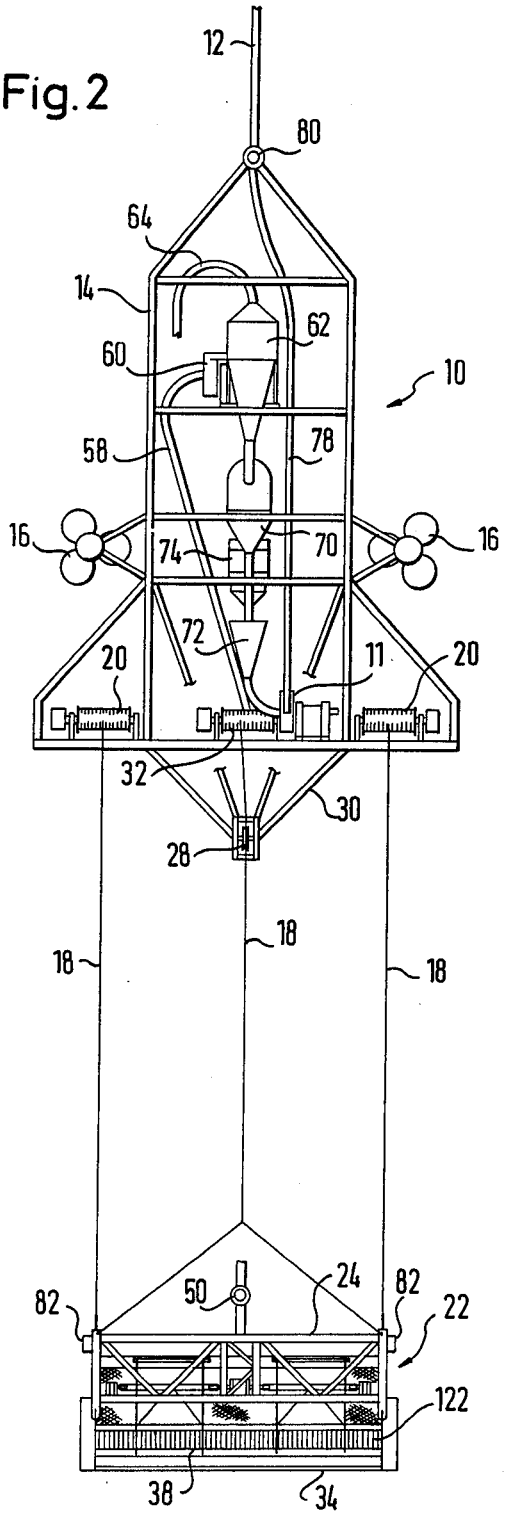
FIG. 2 is a front elevation of the apparatus of FIG. 1.

Referring initially to FIGS. 1 and 2, there is shown a transfer station 10 whose frame 14 is suspended from a mother ship, not itself illustrated, at a fixed depth from the surface by a pipe 12. The pipe provides the conduit for a hydraulic conveyor, presently to be described, which connects the station 10 with the ship, and it also holds electric and hydraulic power lines for the several operating devices mounted on or suspended from the station 10. These devices include two propellers 16 mounted on outriggers of the frame 14 on a common horizontal level at opposite sides of a vertical plane through the center of gravity of the illustrated apparatus. Individual motors turn the propellers 16 about parallel horizontal axes so that their propelling forces may move the station 10 straight forward in a horizontal path or turn the station about a vertically extending axis depending on the rotary speed and direction of rotation of the propellers 16 which are controlled from the mother ship in a known manner, not shown.

Three carrier cables 18 vertically depend from respective winches 20 on the station frame 14 toward respective portions of a dredging tool assembly 22. To prevent swinging movement of the tool assembly on the cables 18, a fourth cable 26 attached to a boom 24 of the tool assembly 22 is trained over a guide pulley 28 at the free end of a boom 30 on the frame 14. The booms 24, 30 are directed forward in the normal direction of movement of the apparatus. The end of the cable 26 on the transfer station 10 is attached to a winch 32 which permits the effective length of the cable 26 between the winch and the tool assembly to be varied. Generally, the angle at which the cable 26 diverges upwardly from a cable 18 should not be smaller than 30°. In the illustrated embodiment, it is approximately 45°.

The principal dredging tool of the assembly 22 is a wedge-shaped blade whose bottom face 34 is generally planar and meets along a scooping or scraping edge 36 with the upwardly sloping top surface 38 of the blade. In the illustrated position of the tool assembly 22, the edge 36 is horizontal, and its elongation has at least a major horizontal component in all operative positions of the assembly 22. The top face 38 leads to a receptacle 40 at its upper end which is a trough of semi-circular cross section about an axis parallel to the edge 38. A conveying screw 42 is coaxially mounted in the trough 40. Material scooped from the sea floor by the blade edge 36 is moved upward over the concavely arcuate top surface 38 into the trough 40 by the bottom portion of a pusher 44 which is mounted on the frame of the tool assembly by a linkage 46 in such a manner that the operating portion of the motor-driven pusher moves cyclically upward from the position illustrated in FIG. 1 in a path contiguously adjacent the top surface 38, but moves downward from the trough 40 in a path indicated by a broken line and arrow which is sufficiently above the surface 38 not to push any material back to the edge 36.

A grate 122 extends along the edge 36 and prevents entry of oversized rocks and other coarse particles into the apparatus. The first conveyor 54 which lifts the scooped material from the tool assembly 22 to the transfer station 10 has an intake pipe 48 whose orifice is at the end of the screw 42 in the trough 40 and leads to a universal pipe joint 50 mounted on the tool assembly in a manner not specifically shown. A pair of telescoping pipes 52 connects the joint 50 to a similar joint 56 on the transfer station 10.

A pipe 58 fixedly mounted on the transfer station 10 leads from the joint 56 to the intake of a slurry pump 60 from which the mixture of water, sludge and nodules is driven into a cyclone separator 62. The fines and particles of low specific gravity and correspondingly long settling time are withdrawn from the top of the separator 62 through a pipe 64 by a pump 66 and discharged into the surrounding ocean water. A fraction of coarse and heavy nodules settles at the bottom of the separator 62 and drops into a rotary screen 68 which retains oversize particles while permitting particles having a desired maximum size to drop into a bin 72 through a chute 70. The larger nodules are continuously fed to a crusher 74, and the output of the crusher drops into the bin 72. A pump 11 of the second conveyor draws a continuous stream of sea water into the bin 72 through an intake pipe 76, and drives the stream entraining the sized nodule material through a discharge pipe 78, a universal joint 80 on the frame 14, and the afore-mentioned pipe 12 upward to the non-illustrated mother ship.

The several motors, not individually described and partly not illustrated, which drive the pumps 11, 60, 66, the winches 20, 32, the screen 68, the crusher 74, the conveyor screw 42, and the pusher 44 are controlled remotely from the mother ship, but the winches 20 are also controlled individually by starting, stopping and reversing relays, conventional in themselves and not illustrated in detail, which are arranged in a housing 84 on the frame 14 and actuated by the output signals of sonar sensors 82 arranged on respective portions of the assembly 22 remote from each other near the ends of the three attached cables 18 and directed toward the sea bottom so as to minimize variations in the distance of each sensor from the sea bottom, each sensor 82 being associated with one winch 20. The scooping edge 36 of the dredging tool is thereby guided quite precisely along the surface of the sea bottom so as to safely scrape the nodules from the surrounding sludge without taking significant amounts of sludge even if the sea bottom is not horizontal. The winches 20 are controlled by the sensors 82 to vary the orientation of the assembly 22 relative to the horizontal when the sea bottom is inclined relative to the horizontal. The effective length of the conveyor 54 varies by telescoping movement of the pipes 52 during raising and lowering of the assembly 22.

The modified dredging tool assembly illustrated in FIGS. 3 to 6 replaces the assembly 22 in the apparatus of FIGS. 1 and 2, otherwise unchanged as far as not specifically described.

Figure 4:
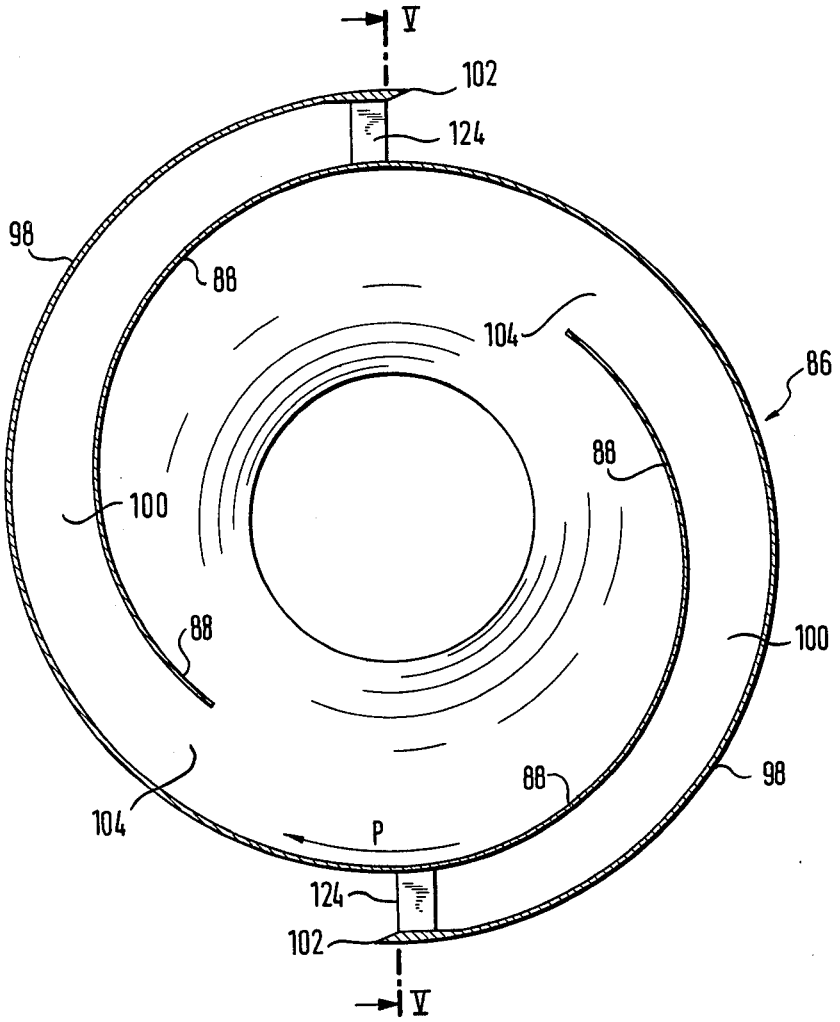
FIG. 4 shows the dredging tool in the assembly of FIG. 3 in section on the line IV—IV.

The dredging tool in the modified assembly is a drum 86 whose axial main portion has inner and outer walls 88, 98, as is best seen in FIG. 4. The two axial inner walls 88 extend in respective cylindrical arcs of 135° about parallel axes of curvature which are offset in opposite directions from the axis of drum rotation and merge with respective outer walls 98 along axial lines. The outer walls 98 are semicylindrical about axes of curvature parallel to the axis of rotation and of greater radius of curvature than the inner walls 88.

The walls 88, 98 thus bound two circumferential channels 100 whose outer orifices each extend between an axial scooping or scraping edge 102 of an outer wall 98 and an inner wall 88. The edges 102 are attached to the inner walls 88 by small plates 124 arranged in closely spaced radial planes to constitute a protective intake grate analogous to the aforedescribed grate 122. The inner orifice 104 of each channel 100 is open toward the central cavity of the drum 86 which is radially bounded mainly by the inner walls 88. When the drum is turned in the direction of the arrow P, the edges 102 scoop nodules from the sea bottom, and the nodules fall through the channels 100 into the central cavity of the drum 86.

Figure 3:
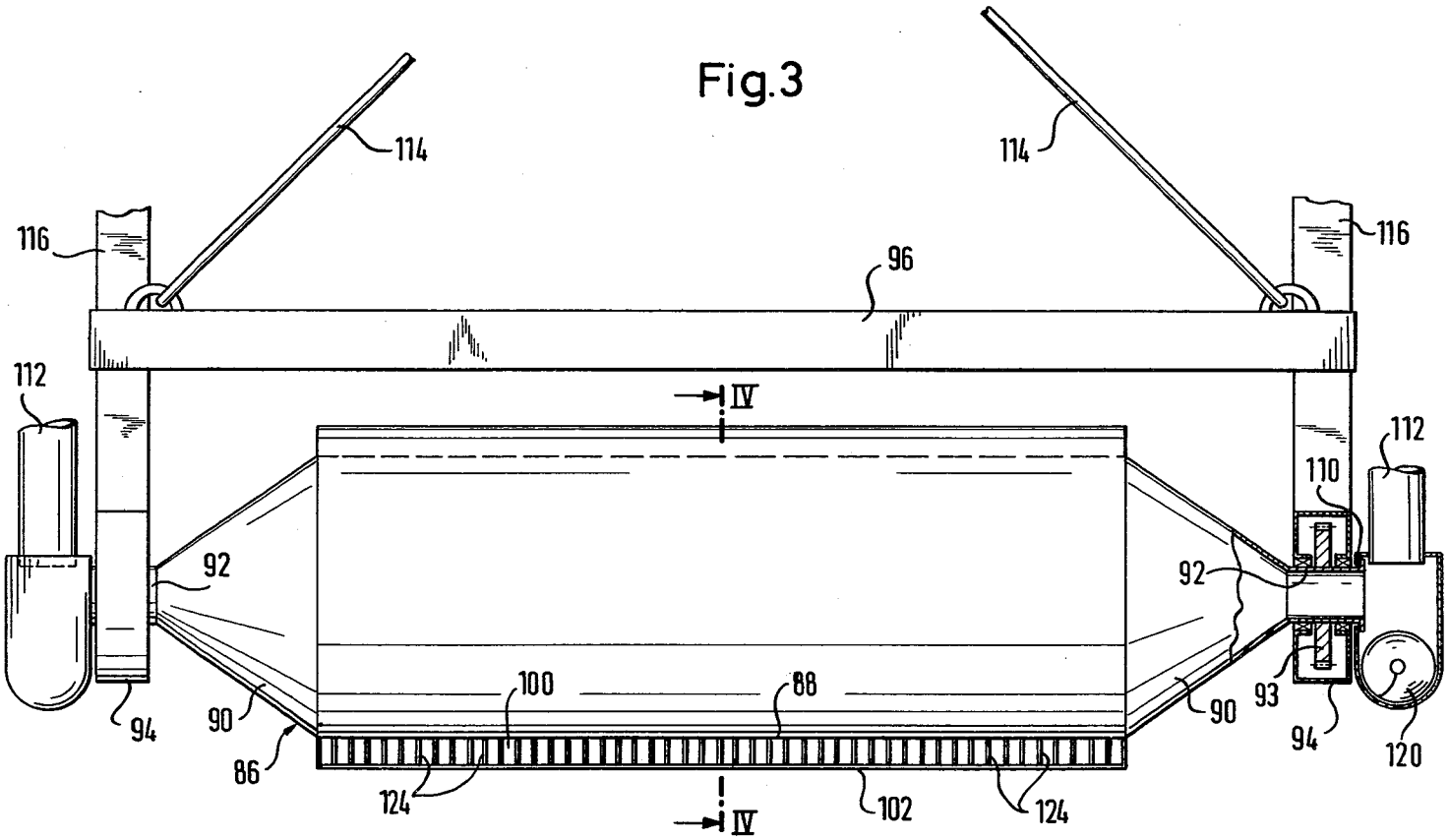
FIG. 3 illustrates a modified dredging tool assembly for use in the apparatus of FIGS. 1 and 2 in front elevation and partly in section.

Reverting to FIG. 3, the two axial end portions of the drum 86 are formed by walls 90 conically tapering from the inner walls 88 toward hollow trunnions 92 journaled in bearings 94 on a supporting frame 96. The frame is suspended from the non-illustrated transfer station by means of a single cable 18 to which it is attached by two bars 114 and by two chain casings 116. Chains, not themselves shown, are trained over sprockets 93 on the two trunnions 92 and over sprockets on gears or motors, not themselves shown, which are fixed on the chain-casings 116. The chain casing 116 are hinged on the trunnions 92 and on the shaft of the pulley 28.

Figure 5:
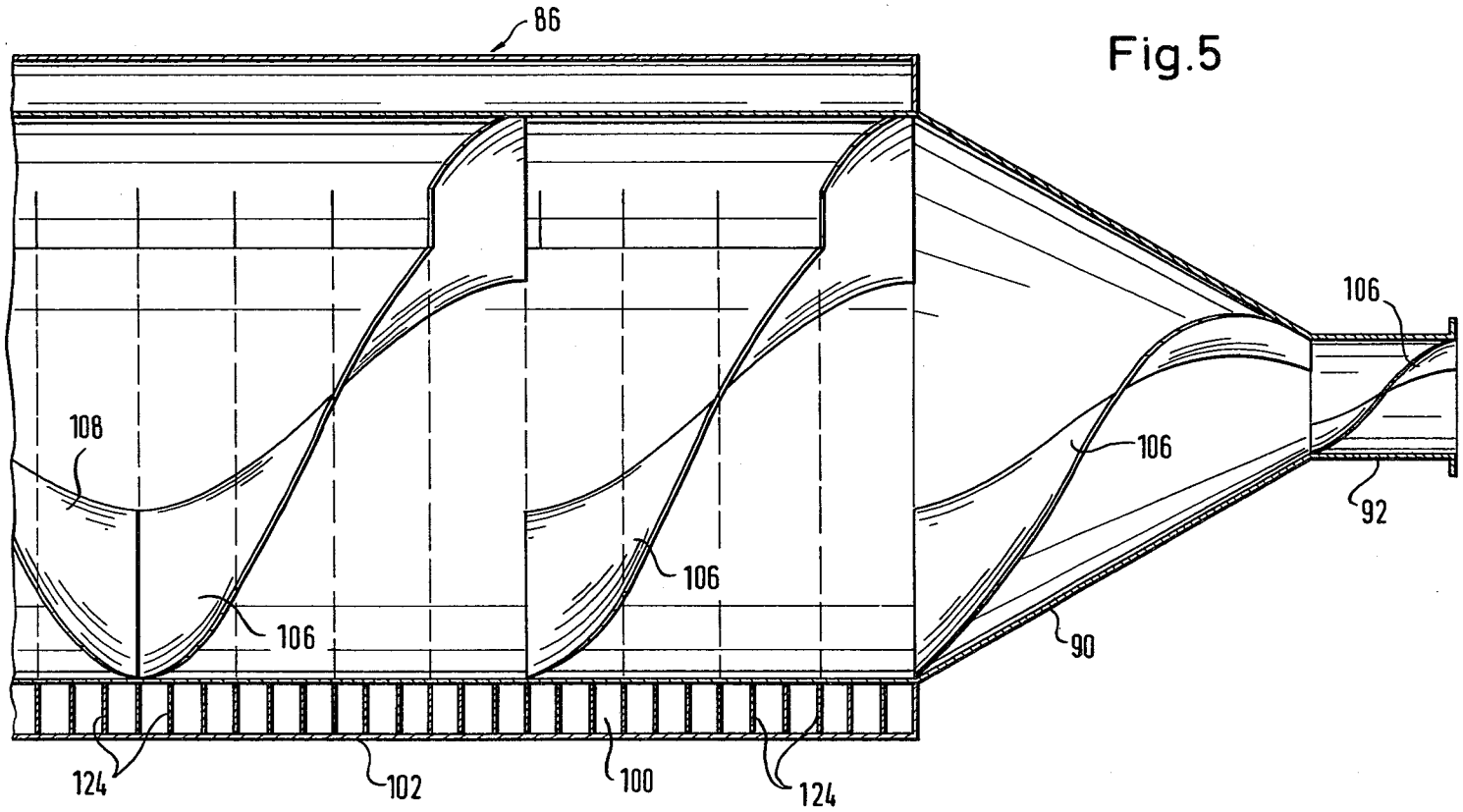
FIG. 5 illustrates the device of FIG. 4 in section on the line V—V.
Figure 6:
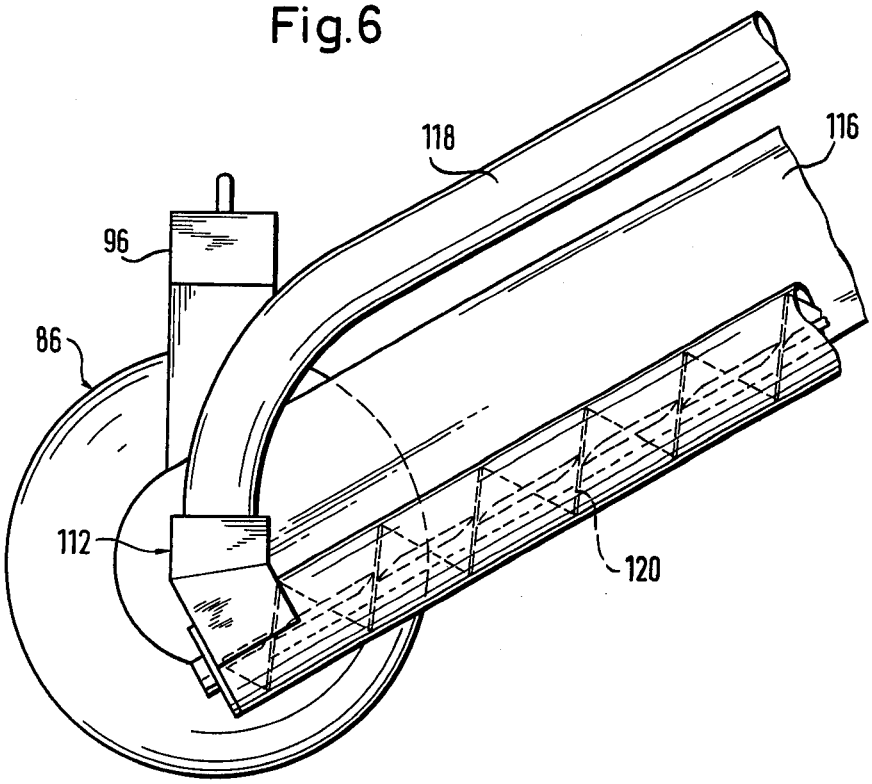
FIG. 6 shows the device of FIGS. 3 to 5 in side elevation.

A baffle shown only in FIG. 5 on the inner faces of the walls 88, 90 and in the trunnions 92 has a right-handed helical portion 106 and a left-handed helical portion 108 in the cavity of the drum 86 which convey respective portions of the dredged material entering the drum cavity toward the two axial end portions and outward of the drum through the trunnions 92. As is best understood by joint consideration of FIGS. 3 and 6, a coupling 112 mounted on the portion of each trunnion 92 projecting beyond the bearing 94 by means of a joint 110 receives the solid material conveyed by the baffle portions 106, 108 and a stream of water drawn into the drum 86 by the pump 60 on the transfer station 10. Most of the coarse, heavy particles drop into a screw conveyor 120 leading to the rotary screen 68 in a manner not specifically shown while the water and solid material suspended therein are pumped into the cyclone separator 62 through branch pipes 118 leading from the couplings 112 to a non-illustrated universal pipe joint analogous to the joint 50.

As is not specifically shown in FIGS. 3 to 6, the supporting frame 96 is equipped with at least one sensor for shortening and lengthening the non-illustrated cable attached to the rods 114 so as to keep the scooping edge 102 closely adjacent the surface of the sea bottom. The apparatus of FIGS. 3 to 6 may be provided with a three-point suspension of the type described with reference to FIGS. 1 and 2 and with three depth sensors to adapt it for work on more irregular bottom surfaces than it can dredge without pumping much sludge.

The transfer station 10 should operate at the lowest level consistent with the configuration of the sea bottom so that it cannot collide with the bottom surface, but is as close as practical to the dredging tool assembly. The power required for operating the winches 20 depends significantly on the inert mass of the cables 18. The apparatus can respond most sensitively to the error signals generated by the sensors 82 when the cables 18 are as short as possible.

The transfer station 10, because of frictional resistance of the sea water, may lag substantially behind the surface ship if the transfer station operates at great depth. Under such operating conditions, the propellers 16 may reduce the horizontal distance between ship and transfer station while the rate of horizontal movement of the transfer station 10 is still determined by the speed of the ship. A rotary movement of the transfer station 10 and of the tool assembly suspended therefrom is frequently convenient for intensively dredging a small area of the sea bottom while the mother ship lies at anchor.

It should be understood, of course, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. Apparatus for recovering manganese nodules from the bottom of the sea comprising:

a. a transfer station;

b. suspending means for suspending said station from a surface ship at a fixed depth;

c. a winch on said station;

d. a flexible tension member depending from said winch;

e. a dredging tool assembly suspended by said tension member from said station;

f. sensing means on said assembly for sensing the spacing of said assembly from said bottom of the sea;

g. control means operatively connected to said sensing means and to said winch and responsive to the sensed spacing for operating said winch and for thereby varying the effective length of said tension member between said winch and said assembly;

h. first conveying means for conveying dredged material from said assembly to said station; and i. second conveying means for conveying said material from said station to said surface ship.

2. Apparatus as set forth in claim 1, further comprising an additional winch on said station and an additional flexible tension member depending from said additional winch, respective portions of said assembly being fastened to said tension members, one of said portions carrying said sensing means, the other portion carrying additional sensing means connected to said control means, said sensing means respectively sensing the spacing of said portions from said bottom of the sea during operation of said apparatus, and said control means being connected to said additional winch for varying the length of each of said tension members in response to the spacing sensed by the associated sensing means.

3. Apparatus as set forth in claim 1, further comprising a plurality of additional winches on said station, an additional flexible tension member depending from each additional winch and secured to said assembly, said additional tension members converging from said station to said assembly at an acute angle greater than 30°.

4. Apparatus as set forth in claim 1, wherein said dredging tool assembly includes a blade member having an edge elongated in a horizontally extending direction and a bottom face and a top face diverging vertically from said edge, a receptacle adjacent a portion of said top face remote from said edge, said first conveying means including moving means for moving said material from said edge toward said receptacle.

5. Apparatus as set forth in claim 4, wherein said moving means include a pusher member, and actuating means for cyclically moving the pusher member in a closed path extending contiguously adjacent said top face from said edge toward said receptacle, and remote from said top face from said receptacle toward said edge.

6. Apparatus as set forth in claim 4, wherein said first conveying means further includes a conveying screw rotatable in said receptacle, said receptacle being elongated in said horizontally extending direction and of circularly arcuate cross section.

7. Apparatus as set forth in claim 1, wherein said dredging tool assembly includes a drum and means for rotating said drum about an axis having a major horizontal component, said drum having an inner axial wall and an outer axial wall, said outer wall having an axially extending scooping edge, said walls bounding therebetween a circumferential channel, said inner wall radially defining a cavity in said drum, said scooping edge and said inner wall defining an outer orifice of said channel, said channel having an inner orifice communicating with said cavity, said first conveying means including baffle means in said cavity for axially conveying a portion of material entering said cavity through said channel toward one axial end portion of said drum, and withdrawing means for withdrawing the conveyed material from said one axial end.

8. Apparatus as set forth in claim 7, wherein said dredging tool assembly further includes a supporting frame, two bearings on said frame, said one axial end portion of said drum including a hollow trunnion journaled in one of said bearings, said drum having another axial end portion journaled in the other bearing, said one axial end portion further including a conically tapering wall connecting said inner wall with said trunnion and enclosing a portion of said baffle means.

9. Apparatus as set forth in claim 1, further comprising propelling means on said station for propelling said station horizontally at said depth.

10. Apparatus as set forth in claim 9, wherein said propelling means include means for turning said station about a vertically extending axis.

11. Apparatus as set forth in claim 10, wherein said propelling means include first means for exerting a first propelling force on said station and second means for exerting a second propelling force on said station, said propelling forces extending in a common direction and acting on respective portions of said platform spaced transversely to said common direction.

12. Apparatus as set forth in claim 1, further comprising processing means connected to said first and second conveying means for selecting from said dredged material conveyed by said first conveying means a fraction of predetermined minimum particle size, for preferentially transmitting said fraction to said second conveying means, and for discharging particles smaller than said minimum size.

13. A method of recovering particulate material from the bottom of the sea which comprises:

a. horizontally moving a transfer station at a fixed depth below the surface of the sea while a dredging tool assembly is suspended from said station;

b. sensing the spacing of said assembly from said bottom;

c. generating a signal indicative of the sensed spacing; and d. varying the level at which said assembly is suspended from said station in response to said signal in a manner to minimize variations in said spacing.

14. A method as set forth in claim 13, wherein said spacing is separately determined with respect to two portions of said assembly horizontally remote from each other, separate signals indicative of the two spacings respectively are generated, and the levels of said portions are varied independently from each other in response to the separate signals, whereby the orientation of said assembly relative to the horizontal is varied if said bottom is inclined relative to the horizontal.

15. Apparatus as set forth in claim 1, wherein the spacing sensed by said sensing means has a predominant vertical component.

16. A method as set forth in claim 13, wherein said dredging tool assembly is suspended from said station in vertically spaced relationship to said bottom.

17. Apparatus as set forth in claim 1, wherein said control means include means for varying the effective length of said first conveying means between said assembly and said station in response to said sensed spacing.

* * * * *